United States Patent [19]

Bailey

[11] 4,176,483

[45] Dec. 4, 1979

[54] MOBILE VISUAL SIGNALLING DEVICE

[76] Inventor: Daniel R. Bailey, P.O. Box 783, Lake Ronkonkoma, N.Y. 11779

[21] Appl. No.: 852,829

[22] Filed: Nov. 18, 1977

[51] Int. Cl.[2] ..... G09F 21/04

[52] U.S. Cl. ..... 40/467; 40/591

[58] Field of Search ..... 40/467, 471, 593, 466

[56] References Cited

U.S. PATENT DOCUMENTS

| | | | |
|---|---|---|---|
| 2,146,834 | 2/1939 | McCain | 40/467 X |
| 2,635,373 | 4/1953 | Barkau | 40/466 |
| 3,678,282 | 7/1972 | Johnson | 40/466 X |
| 3,983,651 | 10/1976 | Dickey | 40/466 X |

*Primary Examiner*—Russell R. Kinsey
*Assistant Examiner*—Wenceslao J. Contreras
*Attorney, Agent, or Firm*—Robert D. Farkas

[57] ABSTRACT

The proposed invention is directed to an electrically driven and electrically controlled film viewing device including a viewing screen and a film transport means including a double reel assembly and further including means to drive the reels and also incorporating electrical control means for the drive means so as to selectively position the film with respect to the viewing screen.

10 Claims, 5 Drawing Figures

MOBILE VISUAL SIGNALLING DEVICE

BACKGROUND OF THE INVENTION

1. The Field of the Invention

This invention relates to visual signalling devices utilized in combination with other similar signalling devices and more particularly to that class having automatic synchronization devices facilitating automatic synchronization of the components thereof.

2. Description of the Prior Art

The prior art abounds with signalling devices for displaying a plurality of messages. U.S. Pat. No. 3,201,785 issued Aug. 17, 1965 to A. E. Knotowicz discloses an indicating device utilizing a plurality of regularly located solenoid coils operating on a permanent mgnet pivotably secured thereinbetween. The permanent magnet is afixed to a drum disposed on the outermost regions of the solenoid coils. A switch arrangement is provided such that upon energizing the appropriate solenoid coil the magnet orients itself in accordance with the location of the selectively energized coil thereby rotating the wheel to a selected position displaying the indicia located in the outermost regions thereof. Such device is capable of displaying a plurality of indicia sites but is ineffective when such plurality is great in number.

U.S. Pat. No. 2,635,227 issued Apr. 4, 1953 to F. Liotta teaches a motor operated elongated cube whose surfaces each carry indicia. Operating the motor displaces the cube in a preferred location such that one surface thereof is disposed adjacent a viewing window in a housing carrying the cube. Light sources are located within the cube and are utilized to emanate light rays, passing through the translucent or transparent indicia carrying cube outwardly from the window of the apparatus. This device suffers the deficiency of only providing four discrete message units capable of being displayed on four adjacent surfaces distributed about the axis of revolution of the cube.

U.S. Pat. No. 3,226,707 issued Dec. 28, 1965 to H. Newman et al discloses a pair of reels, each carrying one end of a elongated strip upon which indicia is disposed. A light source, carried within a housing, similarly carrying the reels and strip, emanates light beams, passing through the strip, terminating on a transparent or translucent window-like opening disposed on one surface of the housing. A plurality of light sources arranged in specific locations, coupled with a motor drive for the elongated strip and a flasher, permits a plurality of displays to emanate outwardly from the display portion of the apparatus. A control box, also provided with individual illumination sources, is operated by a plurality of independent switches such that each light source illuminates a screen upon which companion indicia carrying area is illuminated. Thus, the user is capable of viewing at a remote location, the messages being displayed by the display unit, such messages being motor operated. This apparatus, though utilizing a remote indicator carrying the same message elements as the display indicator, is limited in value by virtue of the fact that the remote indicator and the display indicator can only display a discreet number of messages as a function of the number of switches and light sources used therein. Cost increases in a direct ratio with the number of switches and hence with the number of messages that can be displayed.

SUMMARY OF THE INVENTION

A primary object of the present invention is to provide a display indicator and a control indicator, both being capable of acting as a signalling device wherein both are automatically synchronizable to one another and both are capable of carrying an unlimited quantity of messages.

Another object of the present invention is to provide a display and control indicating apparatus, both of whom being advancable and retractable in simplied form so that messages may be selected by advancing in increments other than one, or in increments of one, at the will of the user.

Still another object of the present invention is to provide an apparatus wherein a number of indicators may be all linked together each of which displays identical messages and each of which may be shifted from a central location, such central location being a site of one of the display apparatuses.

Yet another object of the present invention is to provide a signalling device, capable of being carried on mobile equipment, such as motor vehicles, useful in displaying numerical indicia and word form indicia with equal facility.

A further object of the present invention is to provide a signalling apparatus which is self-synchronizing in discreet areas such that information carried on a strip film may be centered in a viewing screen at the will of the user.

Another object of the present invention is to provide a mobile visual signalling device whose size is totally independent of the method of operation, thus facilitating use as a control unit and use as a display unit.

Still another object of the present invention is to provide a signalling device which is capable of demonstrating the number of the channel currently being used or suggested for use in citizen's band radio transmitter and receiver apparatus, carried by a motor vehicle.

Heretofore, automatic signalling devices, of the strip film variety, represented a unique way of carrying a large number of individual messages in compact form which may be easily selected for display utilizing a specific location of the strip map adjacent a source of light. However, such devices suffer the deficiency of requiring the user to have visual access to the indicia carried by the strip film when positioning the film in any location. Tying together two or more such units represented a hazard because the strip film itself tends to stretch or shrink as a function of weather and time and therefore tends to have the various units comprising an assembled array of them to become unsynchronized and hence useless.

The present invention overcomes these objections by providing a simple technique whereby two or more display apparatuses may be tied together, each of which are independently stoppable at preferred locations wherein each location represents a site for carrying a message or discreet indicia pattern. Furthermore, the present invention overcomes the problem of forcing the user to stop at each site so as to determine the character of the indicia carried thereby, before advancing the site to another indicia carrying site, by utilizing an advancing system, advancable in either direction, in multiples of indicia carrying sites, as well as in single site stepwise fashion. Such apparatus is very useful when required to signal a large number of messages, such as the number of a channel being used, or suggested for use, in citizen radio band applications when such devices are carried by a motor vehicle. In this use, the operator of one vehicle simply alters the location of his control unit strip film until it displays to him the number of the channel which he is using or which he intends to use. Automatically, the slave unit, in similar fashion, will shift to the same position so as to display the same numerical indicia to a source outside the motor vehicle. Both the slave unit and the control unit synchronize when stopping at exact positions representing an indicia site when the number of the channel is centered within a viewing screen area for each unit. If desired, more than two units may be employed, wherein all but one unit represent slave-type units, each unit sensitive to stretching or shrinking of the indicia carrying strip-film.

These objects as well as other objects of the present invention will become more readily apparent after reading the following description of the accompanying drawings.

DESCRIPTION OF THE PREFERRED EMBODIMENT

Figure 1:
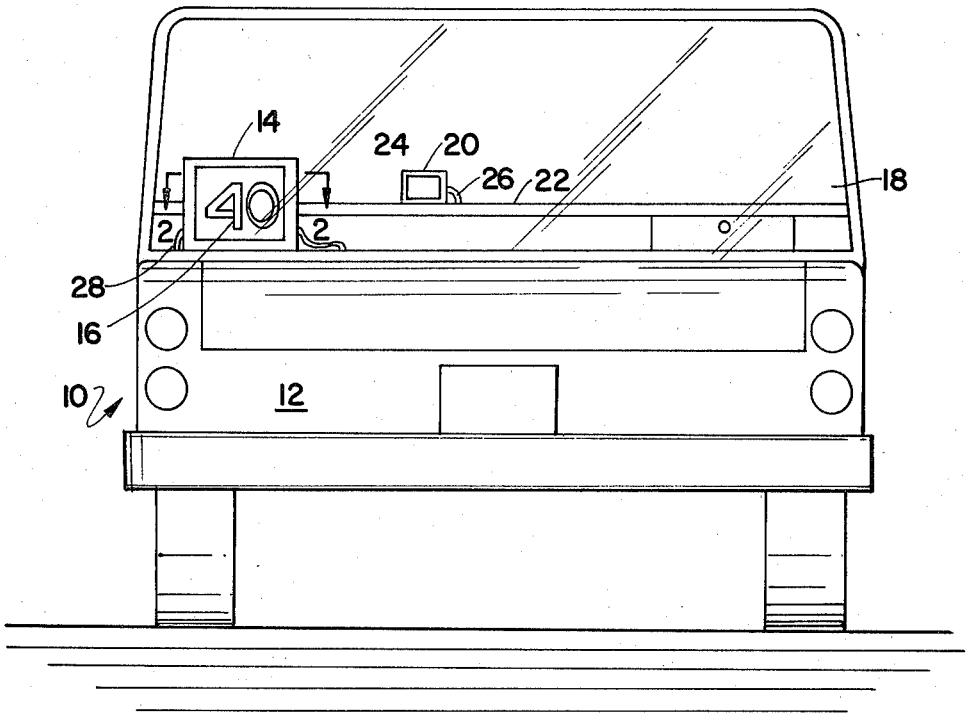
FIG. 1 is a rear view of a motor vehicle carrying a control unit and a display unit.

The structure and method of fabrication of the present invention is applicable to a control unit and a display unit, wherein such display unit is operated in slave-like fashion and is automatically synchronized to the control unit. Both units are similarly provided with housings such that the housings are adapted with a viewing screen forming one part of the housing. A pair of reels are journaled within the housings such that their longitudinal axes are displaced in spaced apart parallel relationship. An incandescent light bulb is also carried within the housing and is centered in between a portion of a film strip whose ends are carried on the reels. The exposed strip film is located intermediate the light bulb and the viewing screen. The film strip carries indicia disposed either in negative or positive fashion by having opaque or transparent areas. Such indicia is divided into two classes. The first class represents the message indicia which is ultimately displayed upon the viewing screen utilizing the light rays emanating from the light bulb therefore. Such indicia may also be viewed through this viewing screen by virtue of the fact of the intimate relationship of the exposed film strip adjacent and parallelly located to the viewing screen. The other class of indicia is in the form of an elongated solid configuration disposed located adjacent the vicinity of each site representing a message site for the message carrying indicia of the film strip. A photo sensitive cell is disposed on the interior of the housing adjacent the location of the viewing screen. Light rays, emanating from the light bulb, either pass thought or are blocked off by the control indicia before encountering the photo-electric sensitive cell. A motor, of the stepdown variety, is rotationally coupled to one of the reels, utilizing a belt and a pair of pulleys therefore. The other reel is biased utilizing a helical spring, one end of which is secured to the housing and the other end of which is secured to the reel itself. Thus when the motor is rotating in any given direction the film strip is wound off from one reel onto another reel causing a change in tension due to the helical spring. When the motor is reversed, the helical spring tends to cause the nondriven and motor-driven reel to rotate such that the film stored thereon is tensioned. The control unit, either being identical too the display unit, or having attatched thereto a series of control components, is utilized to move both strip films, one being carried by the control unit and one being carried by the display unit. Such control unit control devices include four momentary push button switches, each of which advance both motors in a given direction. That is, two of the switches advance the motor in one direction whilst two of the switches advance the motor in another direction. The photoelectric sensitive cell is electrically coupled to an amplifier, sensitive only to a leading edge or the trailing edge of the control indicia by utilizing a diode in series with the output circuit of the photo-electric device and the amplifier. The output of the amplifier controls a units relay, whose contacts, of the normally closed variety are disposed in series with the motor. Thus, when a control indicia is interposed between the lamp bulb and the photo-electric cell, the signal generated by the photo-electric cell caused by the leading edge of the control indicia is amplified by the amplifier signalling the units relay to cause the motor to stop rotating and thereby to cause the motor to force the strip film to stop at a site wherein the display indicia is sensitive in the location of the viewing screen. A capacitor is installed across the coil of the units relay so as to permit the units relay to remain energized for a sufficient period of time to allow the user to remove a control finger from the operating button of the push button switch causing the motor to operate initially. The output of the amplifier is also fed to a counter unit, of conventional variety, such that the output of the counter is in turn fed to a tens unit relay. The counter is operated by a successive count of ten pulses representing ten leading edges of control indicia. Thus, when the counter signals ten display indicia sites have traversed the vicinity of the viewing window, the tens unit relay is operated so as to stop the motor in exactly the same fashion as the units relay. Another capacitor is disposed across the tens unit relay, similar in function to the units relay. The push buttons are electrically arranged such that one push button, designated as a units push button, simply advances the motor until a control indicia area is disposed covering the photo sensitive cell. This push button switch has a separate circuit which shorts out the counter unit such that the counter is inoperative, thereby never allowing the counter to count and operate, in time, the tens unit relay. Another control switch, similar to the unit advance switch is similarly provided with an additional circuit which shorts out the units relay coil such that passing any control indicia site does not operate such relay thereby allowing only tens unit relay to control stopping the strip film in multiples of ten indicia site groupings. Two of the switches are utilized to advance the strip film in one direction, whilst the other two switches are utilized to reverse the strip film in the other direction. Thus the strip film, in both the slave unit and the control unit, are capable of being advanced in unit steps or in steps of ten each. Both units tend to stop at discreet locations wherein the display indicia sites are always located centered within the viewing screen and whereby each apparatus is independently stoppable relative to the other apparatus. They both start to move together but stop independently, thereby taking up errors in the length of the strip film, between both such strip films, due to stretching or shrinking of the film strip. A pair of switches are provided whereby the control unit controls portion may be energized independently of the light bulb portions. Thus, a master switch enables both units to have their light sources energized simultaneously whilst allowing the control portions thereof to be separately energized. This permits the use of the apparatus without illumination and moving the apparatus with or without illumination. No power is consumed when both switches are in the off position.

Nothing herein contained prohibits the use of more than one slave unit, since the control and the slave unit are both provided with terminals which permit such units to be coupled together and other units equivalent in nature to be electrically coupled thereto such that more than one slave unit may be utilized and more than one control unit may be utilized. In point of fact, as disclosed herein, the control unit may be of the variety which simply includes the control elements less a display device which is intended to be used with a pair of slave devices. Alternatively, the control unit may include its own display device and control elements mounted within a common housing to be used in conjunction with one or more slave units, devoid of control components. The control indicia is of elongated form to permit such indicia to continue to signal the input of the amplifier that the motor should stop during the period of time that the motor continues to slew due to its own inertia and the inertia of the reels carrying the strip film. Indicia, both of the display variety and control variety may be black on a transparent base, or any other opaque color, or if desired, may be transparent whilst being carried on an opaque background.

Now referring to the figures and more particularly to the embodiment illustrated in FIG. 1 showing a motor vehicle 10 having a rear most surface 12 in which a slave unit 14 is mounted therewithin, having its control indicia 16 visibly accessible through rear window 18. Control indicia display portion housing 20 is shown mounted on dashboard 22, having indicia 24 visibly accessible through rear window 18. Cables 26 and 28 interconnect the electrical components, not shown, housed within units 14 and 20.

Figure 2:
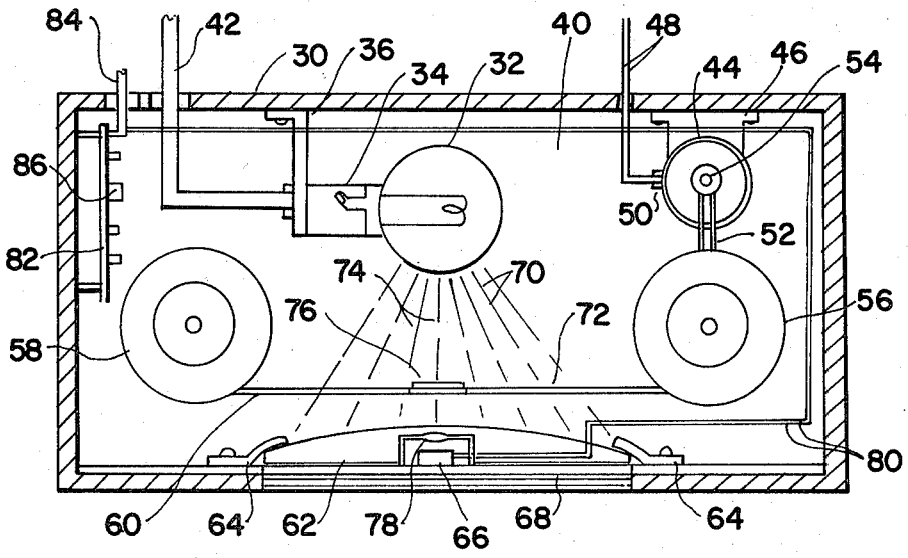
FIG. 2 is a cross sectional plan view, taken through lines 2—2, viewed in the direction of arrow 2—2 of the apparatus shown in FIG. 1.

FIG. 2 illustrates a housing 30, utilized for display purposes, typical of the housing denoted as housing 14 in FIG. 1. Lamp 32 is shown mounted in socket 34, utilizing mounting bracket 36 to secure the lamp within cavity 40 of housing 30. Wires 42 pass outwardly of housing 30 and are electrically coupled to the terminals of lamp 32. Motor 44 is shown mounted to housing 30 utilizing motor mount 46 therefore. Wires 48 are electrically coupled to the terminals 50 of the motor. Belt 52, of the endless variety, connects shaft 54, of motor 44 to reel 56 utilizing a pulley, not shown therefore. Reel 58 is also journaled within the housing in spaced apart parallel relationship with reel 56. Film strip 60 is shown stretched between reels 56 and 58, having the ends of the film strip wound upon the reels in conventional fashion. Lens 52 is secured to housing 30 utilizing mounting clips 64 therefore. Photo-electric cell 66, of any conventional type, is fastened to housing 30 adjacent the area of viewing screen 68, disposed forming a portion of a wall of housing 30. Light rays 70 pass through portion 72 of strip film 60 and then pass through lens 62 and outwardly of viewing screen 68, when lamp 32 is energized. Light rays 74 pass through area 76 of strip film 60 when such area is transparent so as to contact photoelectric sensitive cell 66 by passing through lens 78, such lens being disposed in front of cell 66. Wires 80 interconnect photo-electric cell 66 and circuit board and components carried by circuit board 82. Wires 84 extend outwardly of housing 30 emanating from electrically components 86, carried by board 82.

Figure 3:
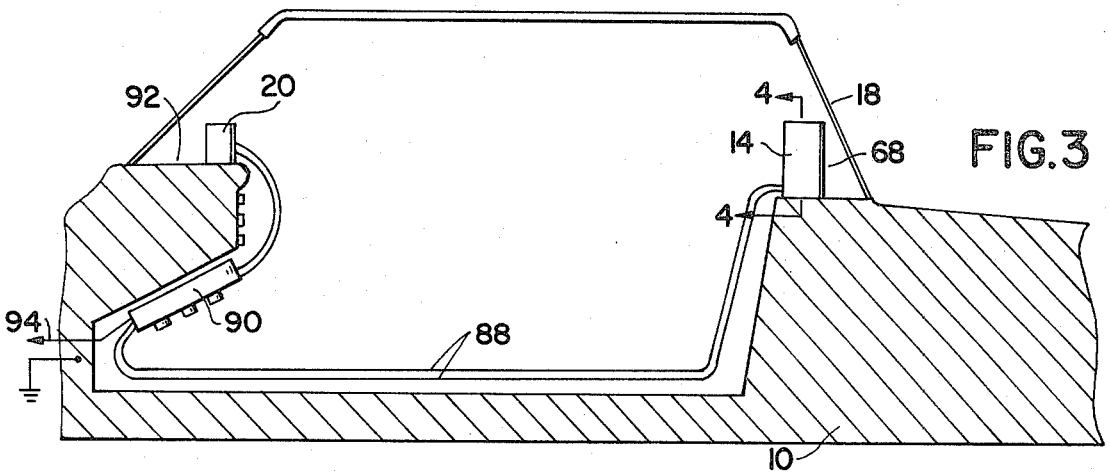
FIG. 3 is a side elevation cross sectional view of the apparatus shown in FIG. 1.

FIG. 3 illustrates a side view of vehicle 10 having rear window 18 disposed adjacent to housing 14 in which viewing screen 68 is shown located adjacent the window. Wires 88 electrically connect housing 14 and control box 90 and control display unit 20. Wires 94 provide electrical energizing power to housings 14, 90, and 20. Housing 20, representing the control unit display is mounted to dashboard 92.

Figure 4:
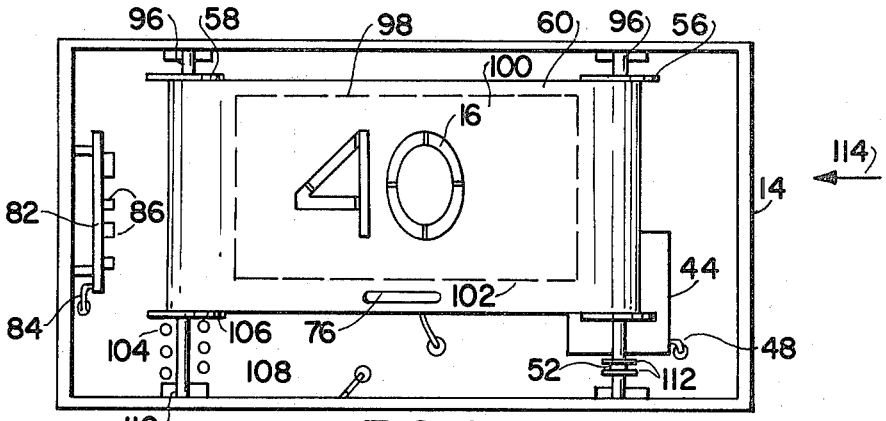
FIG. 4 is a side elevation view of the portion of the apparatus shown in FIG. 2.

FIG. 4 illustrates a portion of the front view of housing 14 in which film strip 60 is shown carried by reels 56 and 58. Both reels are journaled within the housing and are carried by axles 96. Indicia 16, displayed in the form of numeral "40", is illustrated in a display indicia area, delineated by dotted lines 98, such indicia may be opaque or transparent oppositely colored to area 100 adjacent thereto. Control indicia 76 is shown in elongated form, stretching reels 56 and 58 and as diverse optical properties compared area 102 of strip film 60. Spring 104 is shown carried by axle 96 which carries reel 58. End 106, of spring 104 is secured to reel 58, whilst end 108 of spring 104 is secured to bushing 110, in turn secured to housing 14. Direct current operated motor 44 is shown utilizing wires 48, passing through housing 14. Pulley 112 is carried by axle 96 which supports reel 56. Such pulley utilizes endless belt 52 is rotating reel 56 and in rotating reel 58 in slave-like fashion. When motor 44 is operated in one direction, strip film 60 moves in direction of arrow 114. When motor 44 is provided electrical current in the other direction, strip film 60 moves in a direction opposite arrow 114 so as to display another indicia site, equivalent to indicia site 100. Such indicia sites can bear any numerical or word-like message desired. Another control indicia area, similar to area 76, is also positioned intermediate axles 96.

Figure 5:
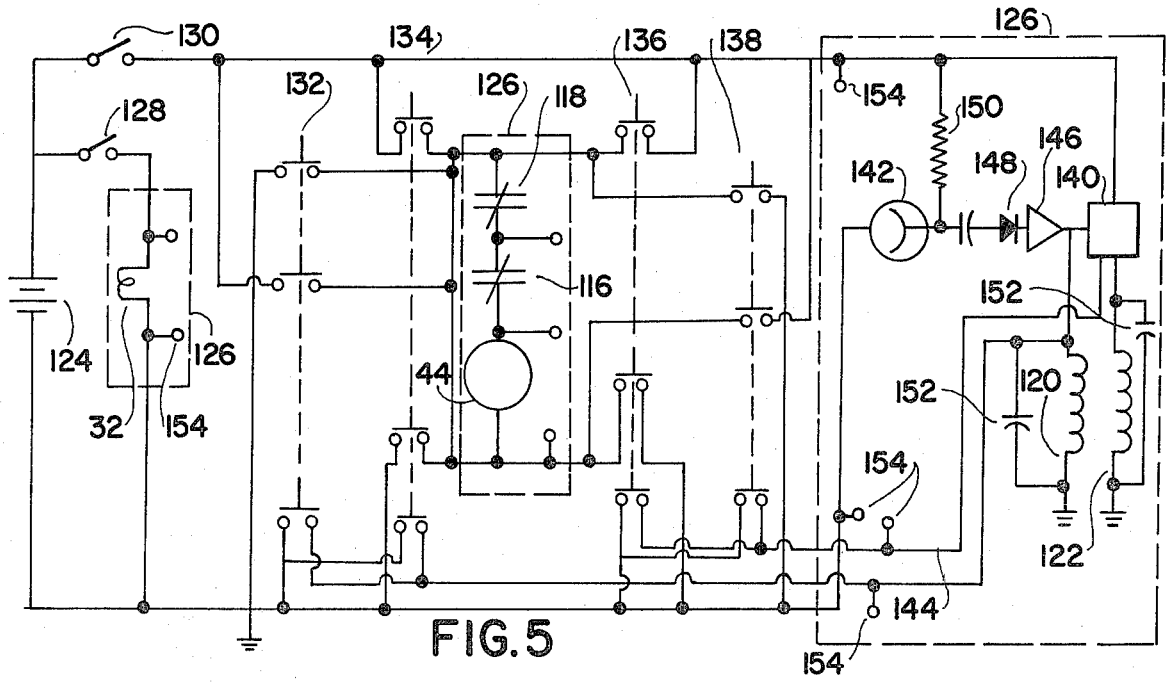
FIG. 5 is a schematic diagram of the electrical components utilized in the control apparatus shown in FIG. 1.

FIG. 5 illustrates motor 44 shown in series with normally closed contacts 116 and 118, each being operated by units relay coil 120 and ten units relay coil 122 respectively. Battery 124 provides operating power for the apparatus. Dotted lines 126 symbolizes the boundaries confining a slave display unit, similar to housing 14, shown in FIG. 3 and a control display unit, similar to control display unit 20, also shown in FIG. 3. All other components are of the variety carried within control box 90, shown in FIG. 3. Switch 128 provides control over lamp 32. Switch 130 provides control power for all the remaining electronic and electrical devices comprising display units and control unit box components. Momentary push button switch 132, when depressed, supplies operating power to motor 44, in one direction, as long as such switch is closed and only as long as contacts 116 and 118 are also closed. Momentary push button 134 also controls motor 44, in a similar fashion. Momentary push button switches 136 and 138 perform similar functions but provide operating power to motor 44, in an opposite direction than do switches 132 and 134, when they are depressed. Hence, switches 132 and 138 cause motor 44 to rotate in one direction whilst switches 134 and 136 cause motor 44 to rotate in the other direction when depressed. Switch 132, when depressed, shorts out relay coil 120 thereby allowing counter 140 to commence counting each time indicia 76, shown in FIG. 4, intercepts light rays entering photoelectric cell 142. When switch 134 is depressed, counter 140 is shorted out, utilizing wire 144, therefore, such that the counter, of conventional variety, will no longer operate causing relay coil 120 to be operable upon signals received from photo sensitive cell 142 being amplified amplifier 146 operating relay coil 120. Diode 148, of any well-known construction, causes electric signals generated across resistor 150 to operate amplifier 146 only on one end of control indicia 76, shown in FIG. 4, passing before lamp 32 and in between and intercepting light rays passing through to photo sensitive cell 142. Capacitors 152 maintain relay coils 120 and 122 in an energized position when energized, for a sufficient period of time to enable a user to remove a manually applied force to any one of control switches 132, 134, 136 and 138. Terminals 154 are shown electrically connected to various components of the apparatus facilitating interconnecting more slave display units and more control display units than shown.

One of the advantages of the present invention is to provide a display indicator and a control indicator, both being capable of acting as a signalling device wherein both are automatically synchronizable to one another and both are capable of carrying an unlimited quantity of messages.

Another advantage of the present invention is to provide a display and control indicating apparatus, both of whom being advancable and retractable in simplified form so that messages may be selceted by advancing in increments other than one, or in increments of one, at the will of the user.

Still another advantage of the present invention is to provide an apparatus wherein a number of indicators may be all linked together each of which displays identical messages and each of which may be shifted from a central location, such central location being a site of one of the display apparatuses.

Yet another advantage of the present invention is to provide a signalling device, capable of being carried on mobile equipment, such as motor vehicles, useful in displaying numerical indicia and words from indicia with equal facility.

A further advantage of the present invention is to provide a signalling apparatus which is self-synchronizing in discreet areas such that information carried on a strip film may be centered in a viewing screen at the will of the user.

Another advantage of the present invention is to provide a mobile visual signalling device whose size is totally independent of the method of operation, thus facilitating use as a control unit and use as a display unit.

Still another advantage of the present invention is to provide a signalling device which is capable of demonstrating the number of the channel currently being used or suggested for use in citizen's band radio transmitter and receiver apparatus, carried by a motor vehicle.

Thus there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

1. A mobile visual signalling device comprising a first display apparatus, a second display apparatus, each of said display apparatuses comprising a housing, a pair of reels journaled within said housing, a strip film, the ends of said strip film secured to said pair of reels, said strip film having a first indicia site and a second indicia site disposed adjacent one another, a light source, said light source being disposed within said housing, a viewing screen, said viewing screen disposed secured to said housing located adjacent said first indicia site, a photoelectric sensing device, said photo-electric sensitive device disposed adjacent said second indicia site and adjacent said viewing screen, said first indicia site carrying display indicia thereon having light transmission characteristics different from the remaining portions of said first indicia site, said second indicia site having an elongated indicia thereon possessing different light transmission characteristics than the remaining portions of said second indicia site, a motor, said motor rotationally coupled to one of said pair of reels, bias means for biasing the other of said pair of reels in a selected rotational direction, said bias means including a spring, one end of said spring fixedly secured to said housing, the other end of said spring fixedly secured to said other of said pair of reels, means to manually selectively energize said motor in an energized state wherein said motor may rotate in one of two directions, means to de-energize said motor upon said second indicia being aligned between said light source and said photoelectric device, an amplifier, said amplifier electrically coupled to said photo-electric device, said amplifier electrically connected to said motor, said means to de-energize said motor including a first relay and a second relay, a counter, said counter electrically coupled between said second relay and said amplifier, each of said first relay and said second relay having a pair of normally closed contacts, said pair of normally closed contacts of said first relay and of said second relay electrically coupled to said motor whereby said photo-electric device provides an output signal responsive to light emanating from said light source and traversing said second indicia so as to selectively operate said first relay and said counter operating said second relay and stopping said motor from further rotation upon selectively a single appearance of said second indicia and multiple appearances of said second indicia adjacent the location of said photo-electric device, whereby said first display apparatus and said second display apparatus each have their respective motors de-energized independently of one another upon said second indicia of each of said apparatuses being individually aligned between said light source and said photo-electric device of each of said apparatuses.

2. The apparatus as claimed in claim 1 wherein said means to energize said motor comprises a plurality of manually operated push button switches.

3. The apparatus as claimed in claim 2 wherein said plurality of manually operated switches comprises a first pair of switches and a second pair of switches, said first pair of switches electrically coupled to said motor, said second pair of switches electrically coupled to said motor, a battery, said battery coupled to said first pair of switches and said second pair of switches, means to provide energizing power to said motor upon the manipulation of said first pair of switches rotating said motor in a different direction than the direction of said motor when said second pair of switches are manually manipulated.

4. The apparatus as claimed in claim 3 wherein one switch of said first pair of manually operated switches is electrically coupled to said motor so as to cause said motor to rotate in one direction, the other switch of said first pair of manually operated switches is electrically coupled to said motor causing said motor to operate in another direction, one switch of said second pair of manually operated switches electrically coupled to said motor causing said motor to operate in said one direction, the other switch of said second pair of manually operated switches electrically coupled to said motor causing said motor to operate in said other direction.

5. The apparatus as claimed in claim 4 wherein said one switch of said first pair of manually operated switches and said one switch of said second pair of manually operated switches disable said counter.

6. The apparatus as claimed in claim 1 further comprising an operating switch, said operating switch electrically coupling said light source to an electrical source of energy.

7. The apparatus as claimed in claim 5 further comprising a capacitor, said capacitor disposed in a parallel electrical circuit with the coil of said first relay, another capacitor, said another capacitor being disposed electrically coupled in a parallel circuit with the coil of said second relay.

8. The apparatus as claimed in claim 5 further comprising means to couple said amplifier to said photoelectric device only on the first appearance of said second indicia when said second indicia passes between said light source and said photo-electric device.

9. The apparatus as claimed in claim 1 wherein said first display apparatus and said second display apparatus are remotely located from one another.

10. The apparatus as claimed in claim 1 wherein said strip film is endless.

* * * * *